United States Patent [19]

Dubrovsky

[11] 4,420,039

[45] Dec. 13, 1983

[54] CORRUGATED-SURFACE HEAT EXCHANGE ELEMENT

[76] Inventor: Evgeny V. Dubrovsky, ulitsa Chaikovskogo, 18, kv. 203, Moscow, U.S.S.R.

[21] Appl. No.: 309,887

[22] PCT Filed: Jan. 15, 1981

[86] PCT No.: PCT/SU81/00005

§ 371 Date: Oct. 6, 1981

§ 102(e) Date: Oct. 6, 1981

[87] PCT Pub. No.: WO81/02340

PCT Pub. Date: Aug. 20, 1981

[30] Foreign Application Priority Data

Feb. 7, 1980 [SU] U.S.S.R. ..... 2872538

[51] Int. Cl.[3] ..... F28F 3/02; F28F 1/22

[52] U.S. Cl. ..... 165/152; 165/166

[58] Field of Search ..... 165/152, 153, 165, 166

[56] References Cited

U.S. PATENT DOCUMENTS

| | | | |
|---|---|---|---|
| 3,151,675 | 10/1964 | Lysholm | 165/166 |
| 3,262,495 | 7/1966 | Baird | 165/152 |
| 4,300,629 | 11/1981 | Hatada et al. | 165/151 |
| 4,332,293 | 6/1982 | Hiramatsu | 165/153 |

FOREIGN PATENT DOCUMENTS

| | | | |
|---|---|---|---|
| 1304691 | 1/1973 | United Kingdom | 165/152 |
| 1312521 | 4/1973 | United Kingdom | 165/152 |
| 336489 | 10/1972 | U.S.S.R. | 165/152 |
| 591684 | 2/1978 | U.S.S.R. | 165/152 |

*Primary Examiner*—Sheldon J. Richter

*Attorney, Agent, or Firm*—Fleit, Jacobson, Cohn & Price

[57] ABSTRACT

A corrugated core structure for a heat exchanger in the form of a corrugated plate, walls 2 of corrugations 1 defining passages 3 for the flow of a heat-transfer agent to pass therethrough. The walls 2 are provided with pairs of extending along the length thereof projections 4 and recesses 5 successively separated by smooth wall portions 6 to effect successive throttling of the heat-transfer agent flow. Each smooth wall portion 6 is of a length essentially below five values of the hydraulic diameter of the smooth portion 6 of the passage 3. The inner curvature radius of the vertex of the corrugation 1 is essentially below a difference between one fourth of the pitch of the corrugations 1 and half the wall thickness thereof, the projections 4 and recesses 5 on the walls 2 of the corrugations 1 having a length capable to ensure an intensified heat transfer process.

3 Claims, 6 Drawing Figures

CORRUGATED-SURFACE HEAT EXCHANGE ELEMENT

FIELD OF THE INVENTION

The present invention relates to heat engineering, and more particularly to corrugated heat transfer structures.

The herein proposed corrugated core structure can find application in various film-tube and ribbed plate heat exchangers for use with any heat-transfer agents.

BACKGROUND ART

Known in the art is a corrugated structure comprised of triangular or rectangular corrugations defining parallelly arranged passages for a heat-transfer agent to flow therethrough. Located at the side surfaces of the corrugations to conform to the path of travel of the heat-transfer agent are continuous successive transverse projections and recesses adapted to define in the passage continuously and successively arranged divergent-convergent portions, the edges of the projections and recesses having stream-lined or rounded off configuration. The side surfaces of corrugations running in parallel with the path of the heat-transfer agent can be further provided with adjacent pairs of the transverse projections and indentations separated along the path of travel of the heat-transfer agent by flat or smooth portions, thereby forming successively alternating smooth and divergent-convergent passages, the projections and recesses extending either across the entire height of the ridges of the corrugations or, alternatively, occupying only part of the height thereof. As a result of constructing or throttling of the flow of the heat-transfer agent, three-dimensional core eddies are induced along the walls of the convergent portion of the passage. Eddy viscosity and conductivity tend to grow in the wall boundary area of the heat-transfer agent stream, which gives rise to an increase in the thermal gradient and density of the heat flow resulting in an improved heat transfer coefficient between the heat-transfer agent and the side walls of the corrugated plate.

However, under certain conditions of the heat-transfer agent flow and at certain dimensions of the projections and recesses power-intensive eddies tend to form in the divergent portion of the passage caused to interact with the flow core as a result of their diffusion thereinto. This entails an increase in the total energy expended for force drafting the heat-transfer agent with practically no improvement in heat transfer between the flow and the side surfaces of the corrugated plate. A similar interaction with the flow core occurs if an eddy formed in the divergent portion of the passage comes across a successive projection to diffuse into the flow core in a construction of a corrugated core structure with continuously arranged transverse projections and recesses separated successively by smooth portions of the walls of the corrugations. Thermohydraulic efficiency of the corrugated core structure of such a design is still low. Insufficient use is made of intensified heat exchange by successive throttling the flow of heat-transfer agent also in the case when the eddy induced in the divergent portion of the passage completely dissipates its energy at the smooth portion of the passage, which is accompanied by restored laminated structure of the boundary layer in the flow of the heat-transfer agent.

SUMMARY OF THE INVENTION

The invention is directed toward the provision of a corrugated core structure wherein heat exchange would be intensified with the utmost thermohydraulic efficiency by successive throttling the flow of a heat transfer agent.

This is attained by that in a corrugated core structure for a heat exchanger fashioned generally as a plate having parallel rows of corrugations, the walls of the corrugations defining passages for the stream of a heat-transfer agent to flow therethrough and provided with pairs of extending along the length thereof projections and recesses successively separated by smooth wall portions, the pairs of projections and recesses being arranged in opposition to one another so as to define divergent-convergent passages providing for successive throttling the flow of the heat-transfer agent to intensify the heat transfer process, the vertices of the corrugations being bent on a smallest possible radius, according to the invention, each smooth portion of the passage is of a length essentially below five values of the hydraulic diameter of the smooth portion of the passage, the inner curvature radius of the vertex of the corrugation being essentially below the difference of one fourth of the pitch of the corrugations and half the thickness of the wall thereof, the projections and recesses provided on the walls of the corrugations having a length capable to intensify heat transfer process.

This prevents the wall boundary eddies from interacting or influencing the core of the flow resulting in less power consumed to intensify the heat transfer process.

The highest thermohydraulic efficiency can be obtained in the case when the projections and recesses are of a length n, or $$n = \frac{F - d^*/d(F + dm)}{2m},$$

where

F is open area of the smooth portion of the passage;

d* is given hydraulic diameter of the narrowest section of the passage;

d is given hydraulic diameter of the smooth portion of the pasasge; and m is height of the projections.

The invention will now be described in greater detail with reference to specific embodiments thereof taken in conjunction with the accompanying drawings, in which.

BEST MODE OF CARRYING OUT THE INVENTION

Figure 1:
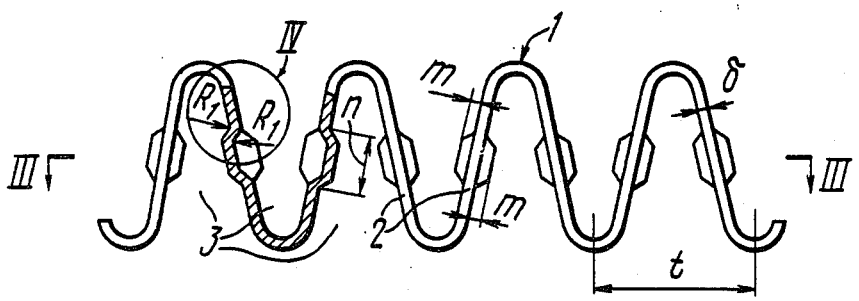
FIG. 1 is a view of a corrugated core structure for a heat exchanger according to the invention.
Figure 2:
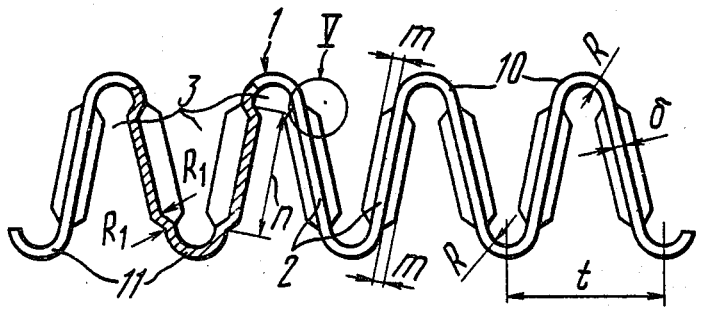
FIG. 2 shows a modified form of a corrugated core structure according to the invention, wherein projections and recesses occupy the entire height of the wall of the corrugation.

A corrugated core structure for a heat exchanger is generally fashioned as a plate having parallel rows of corrugations 1 (FIGS. 1 and 2), the corrugated plate to be placed between flat separating plates of a ribbed-plate heat exchanger, while in a film-tube heat exchanger the corrugations are disposed between the flat tubes or inside the tubes.

Walls 2 of the corrugations define rectangular or triangular passages 3 for a heat-transfer agent to pass therethrough.

Figure 3:
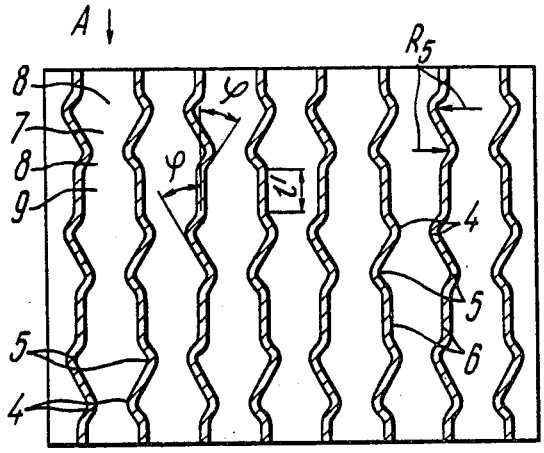
FIG. 3 is a section on the line III—III in FIG. 1.
Figure 4:
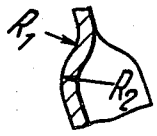
FIG. 4 is an enlarged view of the element IV in FIG. 1.
Figure 5:
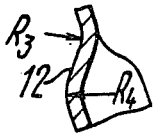
FIG. 5 is an enlarged view of the element V in FIG. 2.

Extending along the entire length of the walls are projections 4 (FIG. 3) and recesses 5 disposed in opposition to each other at the adjacent walls 2 (FIGS. 1 and 2) of the corrugations 1 and separated by smooth portions 6 (FIG. 3). Therefore, the walls 2 (FIGS. 1 and 2) having the pairs of successively arranged projections 4 (FIG. 3) and recesses 5 with smooth portions 6 define arranged successively along the path of travel of the heat-transfer agent indicated generally by the arrow A convergent and divergent portions 7 and 8 respectively separated by smooth portions 9 of the passage. Vertices 10 (FIG. 2) and depressions 11 of the corrugations 1 are rounded off or bent on the inner curvature radius R. Conjugation of the surfaces of the transverse projections 4 (FIG. 3) and recesses 5 with the walls of the corrugations 1 (FIGS. 1 and 2) is effected by a surface defined by the arcs of osculating circles of the radii $R_1$ and $R_2$ (FIG. 4) or by the arcs of the radii $R_3$ and $R_4$ (FIG. 5) conjugated by a line 12 tangent thereto.

The process of convective heat transfer taking place in the passages of the herein proposed corrugated core structure resides in that force drafting the heat-transfer agent along the passages of the corrugated core structure at preset values of the divergence or flare angle $\phi$ (FIG. 3) and curvature radius $R_5$ of the vertices of the transverse projections and recesses is accompanied by a loss in the hydrodynamic stability of the heat-transfer agent flow. As a result, at certain conditions of the flow of the heat-transfer agent characterized by the value Re, three-dimensional eddies in the form of vortex cores or three-dimensional eddy systems are induced along the walls of the divergent portions, the size of the eddies being proportional to the height of the transverse projections 4 and recesses 5.

A study conducted by the inventor has revealed that the wall boundary layer is characterized by the lowest value $\lambda_T$ of turbulent heat conduction, the density q of the heat flow and temperature gradient grad t being the highest. Therewith, the values $\lambda_T^X$ of the turbulent heat conduction inside the flow core are the highest exceeding by several orders of magnitude the values $\lambda^X$ of the molecular conductivity, whereas the value $\lambda$ of molecular conductivity of the wall boundary layer generally acts to define the value of the wall boundary heat flow. No significant increase in the value $\lambda_{XT}$ of turbulent conduction has been brought about by creating additional turbulence in the core of the flow of the heat-transfer agent. Accordingly, by virtue of the fact that the core of the flow occupies a major part of the passage cross-section, additional energy expended for creating extra turbulence in the flow core is unjustifiably high for attaining a corresponding increase in the density thereof. The heretofore described can be illustrated by the Fourier hypothesis, which is transcribed for the case under consideration as $q=-(\lambda+\lambda_T)$ grad t for the wall boundary layer, where $\lambda>\lambda_T$; and $q^X=-(\lambda^X+\lambda_T^X)$ grad t for the core of the flow, where $\lambda^X<<\lambda_T^X$ It follows therefrom that additional turbulization of the flow core requiring between 70 and 90% of additional energy applied to the flow by a vortex generator results in a negligible intensification of heat transfer in the passage. Therefore, if stands to reason that the additional energy must be applied to the wall boundary layer of the heat-transfer agent flow, whereas the height m (FIGS. 1 and 2) of the transverse projections and recesses must be less or at least equal to the thickness of the wall boundary layer of the heat-transfer agent in the passage, since an increase in the height of the transverse projections and recesses results in an increased size of the wall boundary eddies induced. A situation may then arise when the size of the eddies exceeds the thickness of the wall boundary layer in the flow of the heat-transfer agent. Therefore, part of the additional energy applied to the flow of the heat-transfer agent for turbulization thereof outside the wall boundary layer in the flow core will be expended ineffectively.

Due to the fact that the thickness of the wall boundary layer in the flow of the heat-transfer agent along the passage varies depending on the conditions of the heat-transfer agent flow, which conditions are characterized by a range of numerical values $Re=400\div10{,}000$, the required height m of the transverse projections and recesses will correspondingly vary. This will result in a change in the value of the contraction ratio $d^*/d$ of the cross-section of the passage. In the herein proposed corrugated core structure the value of $d^*$ is determined in the narrowest cross-section of the passage and equals $$d^*=4F^*/\pi^*,$$

where $F^*$ and $\pi^*$ are the open area and wetted perimeter respectively of the narrowest cross-section in the passage of the corrugation. The value d of the given hydraulic diameter is determined in the smooth portion of the corrugation passage and equals $$d=4F/\pi,$$

where F and $\pi$ are the open area and wetted perimeter respectively of the smooth portion in the corrugation passage.

It appears from the foregoing that eddies are induced in the divergent portions of the passages of the corrugated core structure according to the invention, the size of the eddies being commensurable with or porportional to the height of the transverse projections and recesses under certain condition of the flow of the heat-transfer agent, as well as at certain values of contraction ratio of the cross-sectional area in the passage and the height m of the transverse projections and recesses. Entrained by the transient flow of the heat-transfer agent, the eddies are carried further along the smooth portion of the passage in the wall boundary area thereof to thereafter gradually subside or die down. The optimum length $l'$ (FIG. 3) of the smooth portion of the passage 9, along which full use is made of the energy of the eddies required for the intensification of the heat transfer process at maximum values of thermohydraulic efficiency of the proposed corrugated core structure, is limited by a value essentially below five given hydraulic diameters of the smooth portions of the passages 9. This occurs due to that within this length $l' \leqq 5d$ the eddies tend to lose their intensity to such an extent that while entering, on the path of travel of the flow of the heat-transfer agent, a successive divergent-convergent portion they fail to cooperate or interact with an eddy formed in this successive divergent portion and thereby fail to diffuse into the core of the flow, but dissipate in the wall boundary area due to viscosity and friction forces arising in the walls. As a result, no additional energy is applied to the core of the flow of the heat transfer agent, thereby making it possible to economize on the total amount of energy expended to intensify heat transfer in heat exchangers employing the herein proposed corrugated core structure.

Figure 6:
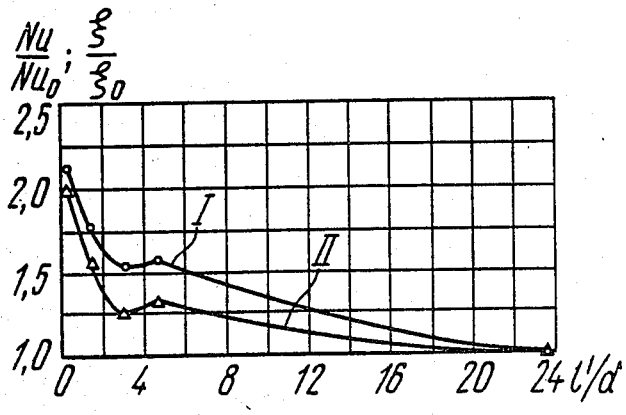
FIG. 6 shows a graph of $$Nu/Nu_o = f(1'/d) \text{ and } \xi/\xi = f_1(1'/d) \text{ at } Re = 1700$$

The above is verified by an experiment, the results of which are represented in the graph $$Nu/Nu_o = f(l'/d) \text{ and } \xi/\xi_o = f_1(l'/d) \text{ (FIG. 6)}$$

for the heat-transfer agent flow condition characterized by the value Re=1700. Here, Nu and $Nu_O$ are Nusselt numbers for the passages of the heat transfer surface defined by successively arranged smooth and divergent-convergent portions and for the identical smooth passages, respectively; $\xi$ and $\xi_O$ are pressure drop factors for the passages of the heat transfer surface defined by successively arranged smooth and divergent-convergent portions and for the identical smooth passages, respectively.

Plotted on the axis of abscissa of the graph is the relative pace or spacing l'/d of throttling, while plotted on the axis of the ordinates are the relationships $Nu/Nu_o$ (curve I) and $\xi/\xi_o$ (curve II). It follows from the graph that the thermohydraulic efficiency of the corrugated core structure according to the invention throughout the whole range of values $l'/d = 0 \div 24$ is more than 1, or $$\frac{Nu/Nu_o}{\xi/\xi_o} > 1;$$

however, within the range of values $l'/d = 0 \div 5$ the relationship $Nu/Nu_o$ is the highest and may reach as high as $Nu/Nu_o = 2.15$, which affords to reduce the overall dimensions and mass of the heat exchangers to half the size and mass of similar heat exchangers employing smooth surfaces.

In addition, less energy is expended for force drafting the heat-transfer agent by virtue of the following facts: rounding off the vertices of the corrugations on a smallest possible radius R (FIG. 2); conjugating the surface of the transverse projections 4 (FIG. 3) and recesses 5 with the wall 2 (FIGS. 1 and 2) of the corrugation 1 by a surface defined by the arcs of osculating circles of the radii $R_1$ and $R_2$ (FIG. 4) or by the arcs of the radii $R_3$ and $R_4$ (FIG. 5) conjugated by the tangent line 12; and the projections and recesses having the length n (FIGS. 1 and 2) providing a more intensive heat exchange process at relatively low amount of energy consumed.

Excessive values of the inner curvature radius of the vertex of the triangular passage of the corrugations leads to a decreased vertex rigidity resulting in that in some instances it becomes impossible to press the corrugations against the separating plates of ribbed plate heat exchangers or against the flat tubes in film-tube heat exchangers, such a press being necessary for soldering purposes. This limits the value of the radius R by $$R = t/4 - \delta/2,$$

where t (FIGS. 1 and 2) is the spacing or pitch between the corrugations 1, and $\delta$ is the thickness of the corrugated structure. At low values of the radius $R < t/4 - \delta/2$ and the absence of the radii $R_1$ and $R_2$ (FIG. 4) or $R_3$ and $R_4$ (FIG. 5), as well as at high values of the length n (FIGS. 1 and 2) of the transverse projections and recesses the generation and spread of eddies in the laminated corner areas of the vertices 10 and depressions 11 of the passages 3 of the corrugations 1 is insufficient, which requires extra energy to be expended for force drafting the heat-transfer agent therethrough.

It has been found by the inventor that the length n of the transverse projections 4 (FIG. 3) and recesses 5 in the herein proposed corrugated core structure becomes well-defined after trial selection of the values of the height m (FIGS. 1 and 2) of the transverse projections 4 (FIG. 3) and recesses 5, as well as after defining the contraction ratio of the passage 3 (FIGS. 1 and 2) of the corrugation 1, which is determined by $$n = \frac{F - \frac{d^*}{d}(F + dm)}{2m},$$

where

F is open area of the smooth portion of the passage;

$d^*$ is given hydraulic diameter of the narrowest cross-section in the passage;

d is given hydraulic diameter of the smooth portion of the passage; and m is height of the projections.

This value n is the optimum value to provide a highest thermohydraulic efficiency of the heat transfer process taking place in the herein proposed corrugated core structure.

INDUSTRIAL APPLICABILITY

Comparative bench and field tests of the standard cooling water tractor radiators equipped with the corrugated core structure according to the invention confirmed that, other conditions being equal, it is possible to reduce by half the size and weight of the radiator provided with the proposed corrugated core structure. The water cooling radiators being a mass produced commodity, considerable economic advantages are liable to be gained from the use of the herein proposed corrugated core structure in the production of water cooling tractor radiators alone.

We claim:

1. A corrugated core structure for a heat exchanger, said core structure comprising: a plate having parallel rows of corrugations, the walls of the corrugations defining passages for streams of a heat-transfer agent to flow therethrough, pairs of opposed projections and recesses successively separated by smooth wall portions, the pairs of projections and recesses being arranged in opposition to one another so as to form divergent-convergent portions of the passages and having a length sufficient to intensify the heat transfer process; the smooth portions of the passages alternating with said divergent-convergent portions such that, in combination, they provide for successive throttling of the flow of the heat-transfer agent to intensify the heat transfer process, each said smooth portion of the passage having a length essentially below five values of the hydraulic diameter of said smooth portion in the passage; the vertices of said corrugations being bent on a radius, the value of which is essentially below a difference between one fourth of the pitch of said corrugations and one-half the wall thickness thereof.

2. A corrugated core structure as claimed in claim 1, wherein the projections and recesses are of a length n, or $$n = \frac{F - d^*/d(F + dm)}{2m},$$

where

F is open area of the smooth portion of the passage;

$d^*$ is given hydraulic diameter of the narrowest cross-section in the passage;

d is given hydraulic diameter of the smooth portion of the passage; and m is height of the projections.

3. A heat exchange element having a corrugated surface formed from a plate having parallel rows of corrugations wherein the corrugation walls define passages for the flow of a heat exchange agent, said corrugated walls having projections and recesses successively separated by smooth wall portions and spaced in an opposed relationship on adjacent corrugated walls to form converging and diverging passages in order to effect periodic throttling of the heat exchange agent and thereby intensify the heat exchange process, wherein each smooth portion of said passages has a length ranging from nil to five flow diameters at the smooth portion of the passage, and wherein the inside radius of the corrugation crest is less than the difference between one-fourth of the corrugation pitch and one-half its wall thickness and is equal to 35 to 95% of the value of the radius.

* * * * *